US005471851A

United States Patent [19]

Zakryk

[11] Patent Number: 5,471,851

[45] Date of Patent: Dec. 5, 1995

[54] SELF-REGULATING SWIMMING POOL HEATER UNIT

[76] Inventor: John M. Zakryk, 1300 S. Andrews Ave., Pompano Beach, Fla. 33069

[21] Appl. No.: 212,816

[22] Filed: Mar. 15, 1994

[51] Int. Cl.[6] ..... F25B 27/00

[52] U.S. Cl. ..... 62/238.6; 62/127; 62/129; 62/231

[58] Field of Search ..... 62/238.6, 238.7, 62/228.3, 157, 231, 126, 127, 129

[56] References Cited

U.S. PATENT DOCUMENTS

| | | | |
|---|---|---|---|
| 4,041,723 | 8/1977 | Weibel, Jr. et al. | 62/231 X |
| 4,387,368 | 6/1983 | Day, III et al. | 62/129 X |
| 4,402,190 | 9/1983 | Reid | 62/238.6 X |
| 4,612,775 | 9/1986 | Branz et al. | 62/127 X |
| 4,653,287 | 3/1987 | Martin, Jr. | 62/238.6 X |
| 4,907,418 | 3/1990 | DeFazio | 62/238.6 |
| 5,058,392 | 10/1991 | Jouan et al. | 62/238.6 |
| 5,218,837 | 6/1993 | Moore | 62/228.3 |

*Primary Examiner*—Harry B. Tanner
*Attorney, Agent, or Firm*—Malloy & Malloy

[57] ABSTRACT

A self-regulating swimming pool heater unit to be utilized with single or dual pump pool filtration systems, the unit including a main unit housing wherein there is contained a refrigeration unit structured and disposed to emit heat, as a byproduct of its cooling cycle, so as to heat filtered pool water passing through an internal, coiled flow through path within the refrigeration unit. The heater unit further including a plurality of internally contained single pole, double throw switches, a first, second, third, fourth, and fifth of those switches being connected in series with one another such that only when all of those switches are positioned in their normally closed position, will the refrigeration unit be able to operate. Each of those first, second, third, fourth, and fifth switches being connected to a regulating device which will cause switches to move to an open position and will cause a particular indicator light to turn on. Further, the heater unit includes an automatic timer and an automatic timer bypass adapted to enable the heater unit to function even during periods of time not designated by the timer.

5 Claims, 1 Drawing Sheet

SELF-REGULATING SWIMMING POOL HEATER UNIT

BACKGROUND OF THE INVENTION

1. Field of the Invention

The present invention relates to a self-regulating swimming pool heater unit adapted to internally regulate its functioning and facilitate the identification and fixing of common unit malfunctions.

2. Description of the Related Art

Heater units utilized for heating water in swimming pools, spas, or swimming pool/spa combinations generally employ refrigeration units to heat the water. The heating is achieved as a byproduct of the cooling cycle performed by the refrigeration unit's compressor. Due to the adaptation of a refrigeration unit to perform a heating function, many conditions regarding the operating environment of the unit should be maintained to prevent serious system breakdown. One such condition relates to the ambient air temperature when the unit is utilized. Because a pool heater is originally built as a refrigeration unit, and because refrigeration functions are still performed to create the heat, if the ambient air temperature drops below the temperature range in which the refrigeration unit would normally be utilized, freezing and compressor malfunctions can result. Further, if the heat is not being eliminated at a sufficient rate, either because of zero or low water flow through the unit, difficulties can quickly arise. To attempt to minimize such difficulties, many known units utilize timers to regulate the use of the system by assuring the unit does not run continuously for extended periods of time.

Currently in the art, pool heater and pump systems, if they utilize a timer, utilize external wall mounted timers which must be adapted and connected to the heater for use. This adaptation can often be expensive and complex as standard external timers use numerous relays and the like to regulate the system functions. Further, if system regulation based on the operating conditions of the unit are to be performed, known regulating means merely shut down the system and do not provide for any indication as to whether there is only a temporary or minor malfunction.

Accordingly, it would be highly beneficial to have a unit which is internally wired in a cost-effective and efficient manner so as to provide immediate and clear identification of minor shutdowns, which regulates the functioning of the system such that it will not overload or attempt to be active when more serious malfunctions could result from continuous functioning, and can internally regulate the operating time of the unit while still enabling immediate demand use of the unit when required by a user.

SUMMARY OF THE INVENTION

The present invention relates to a self-regulating swimming pool heater unit to be used with a swimming pool, spa, or swimming pool/spa combination. The heater unit includes a main unit housing wherein all components of the heater unit are contained. The heater unit primarily includes a refrigeration unit utilizing an compressor. In order to provide ambient air for heating within the compressor, the refrigeration unit includes an ambient air intake. Within the refrigeration unit, cooling means, including refrigerant, cool the air drawn in through the ambient air intake, the cooling of the air causing substantial heat to be emitted.

Also included within the refrigeration unit is an internal, coiled flow through path. This flow path is adapted to enable the passage of filtered water therethrough and is positioned such that the heat emitted during the cooling of the air is directed towards the flow through path, accordingly heating the water passing therethrough.

Further included as part of the heater unit itself are a plurality of single pole, double throw switches. These switches, which are connected to the refrigeration unit and are disposed in a normally closed position, are adapted to be connected with various regulating apparatuses also contained within the heater unit. More particularly, the regulating apparatuses to which the first five switches are connected include a water thermostat, a water pressure switch, an ambient temperature switch, a freon low pressure switch, and a refrigerant high compressor pressure switch. These varying apparatuses are calibrated to the minimum/maximum conditions in a working environment of the heater unit which could lead to serious damage to the heater unit if not shut off. In order to assure that all of the working conditions are in a proper range, those first five switches are connected in series with one another such that only when all of the switches are in their normally closed position will the refrigeration unit be able to function. If during use, any of the five switches moves to its open position, the heater unit will cease to function. In addition to those switches, a sixth switch is connected to timer means. The timer means are adapted to select predetermined times during which the sixth switch is in the normally closed position. Accordingly, the timer means includes a clock, an adjustable on-time indicator and an adjustable off-time indicator to facilitate a user's determination of when the sixth switch will be in its normally closed position. The sixth switch is particularly structured and disposed such that when the sixth switch, along with the first through fifth switches connected in series, are in their normally closed position, will the refrigeration unit be on. So as to facilitate functioning of the heater unit at specific times despite the timer means, the heater unit includes an automatic timer bypass. This timer bypass includes primarily a seventh switch. This seventh switch is adapted to be manually positionable between its normally closed position and an open position. Further, the seventh switch is disposed such that if the seventh switch is moved to its normally closed position, and if said first through fifth switches are in their normally closed position, the refrigeration unit will be on despite the sixth switch being in its open position. Essentially, the automatic timer bypass functions to assure that the water is maintained at a desired temperature no matter what time of day.

It is an object of the present invention to provide a self-regulating swimming pool heater unit which includes self-contained safety and regulating checks to assure that the heater unit is functioning properly and at proper capacities to minimize malfunctions.

It is a further object of the present invention to provide a heater unit which can internally regulate and monitor itself thereby eliminating the need to utilize and integrate exterior monitoring devices.

Still another object of the present invention is to provide a heater unit which will internally regulate itself utilizing simple, effective switching mechanisms.

Yet another object of the present invention is to provide a heater unit which will enable a facilitated bypass of timed on cycles.

A further object of the present invention is to provide a heater unit which will permit the use of timed and bypass functioning cycles directly controlled and initiated at the heater unit rather than through outside mechanisms.

An additional object of the present invention is to provide a heater unit which can efficiently and without extensive adaptation provide for immediate identification of commonly occurring malfunctions or hazardous operating conditions which can necessitate the shut down of the heater unit until remedied.

A further object of the present invention is to provide a heater unit which through the use of a number of internally controlled indicators enables a user to individually identify a malfunction or hazardous operating condition without the need for a service call to identify minor difficulties.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
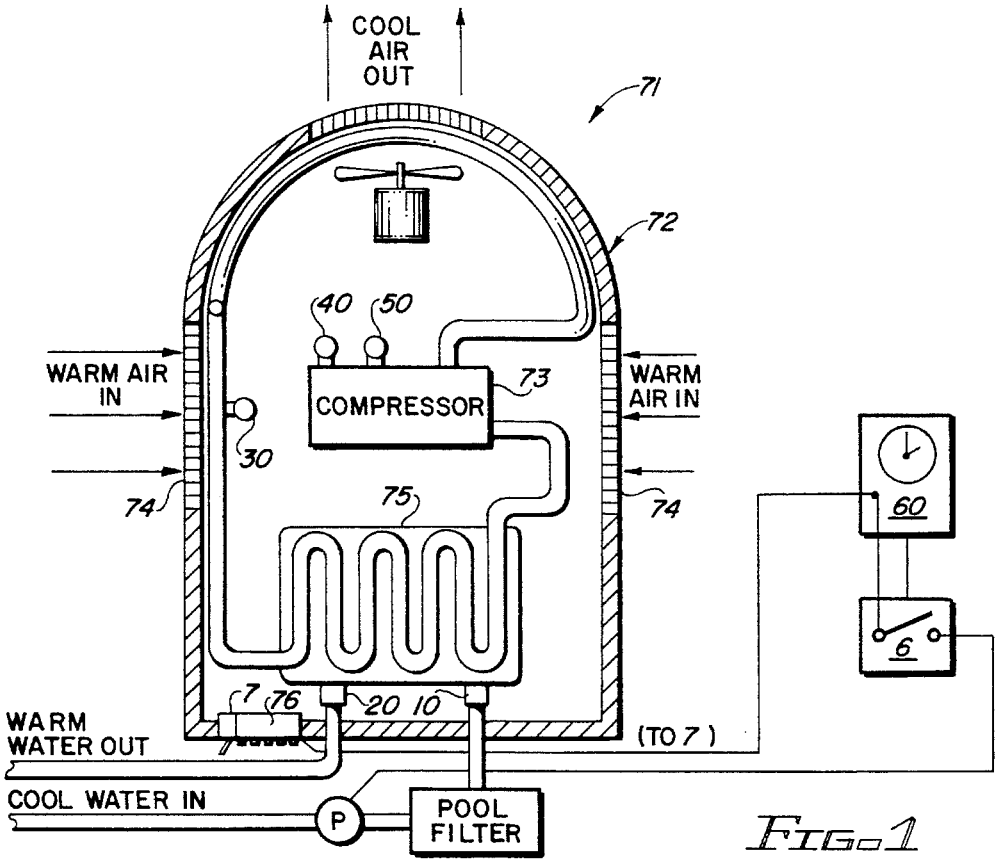
FIG. 1 is a top schematic view of the heater unit of the present invention.
Figure 2:
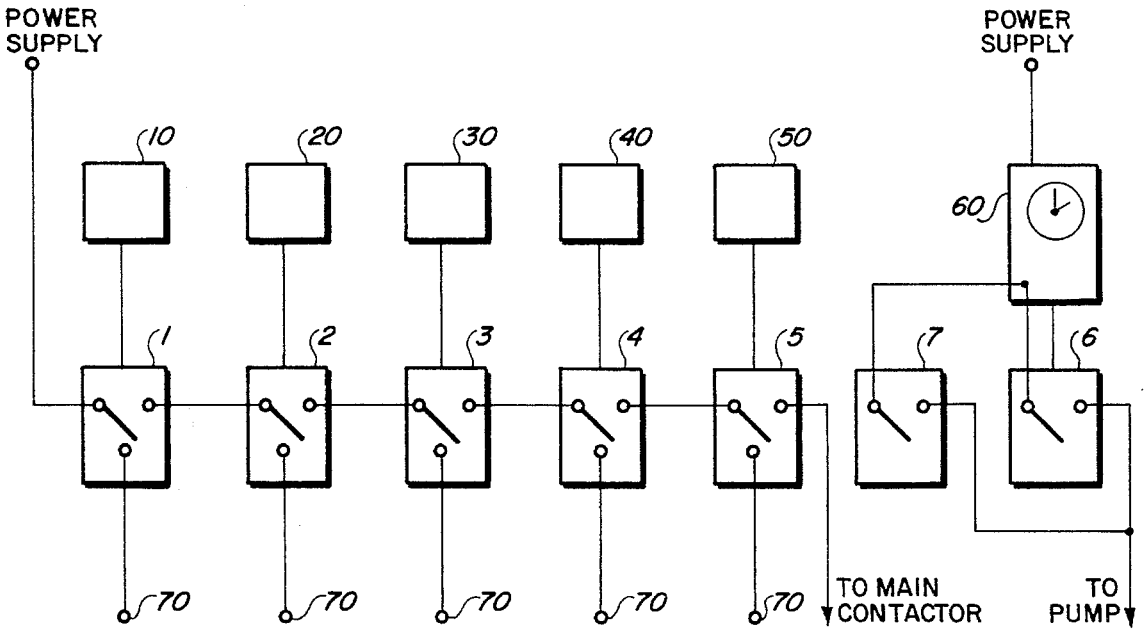
FIG. 2 is a flow chart illustrating the functioning of the various regulating apparatuses and switches.

The present invention is directed towards a self-regulating swimming pool heater unit generally 71, to be used with a swimming pool, spa, or swimming pool/spa combination. The heater unit is adapted to be connected in line with the pool pump A and filter B such that filtered water will be passed through the heater unit prior to returning to the pool or spa. The heater unit includes primarily a main unit housing 72 which contains substantially all of the components of the heater unit. The particular size of the main unit housing varies dependent on the heating requirements for the particular heater unit. Employed within the main unit housing in order to heat the water is refrigeration unit. The refrigeration unit is preferably of the type which utilizes a compressor 73, and the specific size and dimensions of the refrigeration unit will vary according to the specific heating needs of the system. In order to provide ambient air for heating within the compressor, the refrigeration unit includes at least one ambient air intake 74 . Through the ambient air intake, air is drawn into the evaporator coil where cooling means, preferably including refrigerant, cool the air. The cooling cycle performed by the refrigeration unit is much like the cooling cycles performed by refrigeration units utilized in central air conditioning and like applications. In this circumstance, however, the substantial heat formed as a result of the cooling of the air is utilized to heat water for a spa or swimming pool. As a result, an internal, flow through path 75 is included in the refrigeration unit through which filtered water will pass. The flow path is preferably coiled to maximize the exposure of filtered water to the heat formed by the refrigeration unit. The heater unit is connected in line with the pump and filter assembly of the swimming pool such that water will be drawn from the swimming pool as is normal with the filtration cycles and then passed through the heater unit before returning to the swimming pool or spa. If the heater has been set to run, water passing therethrough will be heated, and if not, the water will merely pass therethrough and return to the pool or spa at its previous temperature. This type of refrigeration unit is the type generally employed for pool/spa heating purposes, however, due to the often cold environments in which they are employed, specific operating conditions must be maintained in order to prevent significant breakdown and malfunction.

In order to minimize the effects of varied, unacceptable operating conditions, the heater unit includes various regulating apparatuses built in. Each of these regulating apparatuses is connected to one of a plurality of single pole, double throw switches which control the operation of the refrigeration unit. Specifically, a first switch is connected with a water temperature thermostat 10. The water temperature thermostat is designed to periodically sample the water entering the flow through path so as to determine its temperature. The sampled water temperature is then compared to a preset desired water temperature as determined by a user. The water temperature thermostat 10 enables an adjustable range of water temperatures to be achieved, thereby enabling its use for pool or spa use. When the desired water temperature has not yet been attained, the first switch 1 remains in its normally closed position. When, however, a desired water temperature is achieved, the first switch 1 will be moved to an open position resulting in the shutting off of the refrigeration unit. Additionally, a second of the switches 2 within the heater unit is connected to a water flow pipe 20. The water flow pipe is specifically adapted to determine the rate of water flow passing through the flow through path. If during use, the rate of water flow drops below a predetermined minimum water flow rate, the low water flow rate will cause the second switch to move from its normally closed position to an open position wherein the system is shut off. It is essential that sufficient water flow is present during the operation of the refrigeration unit because if insufficient water is present, the heat formed will not be adequately dissipated resulting in serious overheating and potential damage to the refrigeration unit.

A third of the switches 3 contained within the heater unit is connected to an ambient temperature thermostat 30. Because the refrigeration unit is being utilized for a "unintended" purpose, the refrigeration units are not designed to function in colder temperatures. Specifically, if cold air is drawn into the refrigeration unit and further cooled, the refrigeration unit can freeze up and be potentially damaged. As a result, at certain low temperatures, the refrigeration unit should not be employed and other means of heating must be utilized. Accordingly, the ambient temperature thermostat 30 always samples the ambient air temperature and if the ambient air temperature drops below a set minimum level, the third switch 3 will be moved from its normally closed position to an open position resulting in a system shut off. Further disposed within the heater unit and connected to a fourth of the switches 4 is a low refrigerant pressure detection means 40, such as a pressure gauge. The refrigerant pressure detection means 40 is adapted to determine the refrigerant pressure within the refrigeration unit. If during use the refrigerant pressure drops below a predetermined minimal level, the refrigerant pressure detection means 40 will result in the fourth switch 4 moving to its open position and accordingly shutting off the system. Finally, in the preferred embodiment, a fifth switch 5 is connected to a high refrigerant pressure detection means, which can be the detection means 40 as well, or a separate detection means 50. The high refrigerant pressure detection means 50 is included to detect the pressure build-up within the compressor and if the refrigerant pressure increases above unsafe or hazardous or predetermined level, the fifth switch 5 will be caused to move to its open position shutting off the system.

The first, second, third, fourth, and fifth switches are all connected in series with one another such that only when all of the switches are in their normally closed position will the power not be interrupted and the system be allowed to function. Also, each of the single pole, double throw switches is fitted with a third wire. The third wire is adapted to be connected to an indicator light 70 which will be visible on an exterior panel 76 of the main housing. There are a plurality of the indicator lights, each corresponding a specific system malfunction as detected by the various regulating apparatuses. The third wire is connected such that when any of the switches is moved to their open position resulting in a system shut off, the indicator light will immediately turn on and stay on. In this manner, a user of the heater unit can independently observe what the malfunction is without necessitating that a service call be made when the malfunction is only temporary or minor. It is of particular importance that the numerous switches be connected in series with one another and include the third wire thereby eliminating the need for complicated and costly relays and minimizing system malfunctions relating to the various regulating apparatuses which could eventually lead to serious damage to the heater unit as a whole.

Also connected, either externally or internally, with the unit 71 is a sixth switch 6. The sixth switch 6 is connected to timer means 60 adapted to set predetermined times over which the heater unit will function. Since individuals often want heated water at certain times, the heater unit of the present invention includes a built in timer 60 having a clock, an adjustable on time indicator, and an adjustable off time indicator. By presetting the time of the day which the unit should be turned on and off, a user can be assured that water is being heated only during the desired times. It is important that this sixth switch 6 is also connected such that only if the appropriate operating conditions are achieved and the first five switches remain in their normally closed position will closing of the sixth switch during the desired operation time be effective. For instance, if a user does not wish to correlate their pool pump and filter operating times with the heater unit operating times, or mistakenly sets different times, the heater unit will not be allowed to function even though the sixth switch is moved to its closed position because the operating conditions such as sufficient water flow have not first been achieved. Because heater units will most commonly be employed with spas, it is often not necessarily to integrally connect the pool pump operation with the heater unit operation because in order to use the spa, the pool pump must naturally be turned on to provide the circulating water, thereby assuring that water flow conditions are met within the heater unit and the heater unit will operate. Connected with the sixth switch is a seventh switch 7. This seventh switch 7 functions as an automatic timer bypass and is merely a toggle switch which can be moved between an open and closed position. This automatic timer bypass is normally left in an open position such that the timer 60 will regulate when the system is on. If, however, a user decides that they wish to utilize a spa or otherwise heat the pool or spa at a time which has not been previously set by the timer, and also does not wish to readjust the timer, the user need only move the seventh switch 7 to its closed position. When moved to its closed position, the seventh switch of the automatic timer bypass results in a bypass of the timer, thereby consistently maintaining the water at the desired temperature no matter what time it is and what operating times have been set at the timer.

Now that the invention has been described,

What is claimed is:

1. A self-regulating swimming pool heater unit comprising:

a refrigeration unit, said refrigeration unit including an compressor and an internal, coiled flow through path structured and disposed to enable the passage of filtered water therethrough, said refrigeration unit including an ambient air intake structured and disposed to draw heat from ambient air into said compressor, said refrigeration unit including cooling means structured and disposed to cool air drawn in through said ambient air intake, said cooling means including a refrigerant, said cooling means being structured and disposed to cause heat to be emitted by said refrigeration unit into said internal coiled flow through path thereby heating the water passing therethrough, a plurality of single pole, double throw switches, said switches being connected to said refrigeration unit and being disposed in a normally closed position, a first of said switches being connected to a water thermostat, said water thermostat being structured and disposed to periodically sample the water exiting said internal coiled flow through path so as to determine its temperature, said water thermostat being adjustably set to determine a desired water temperature, said water thermostat being further structured and disposed to cause said first switch to move from said normally closed position to an open position upon the water attaining said desired water temperature, a second of said switches being connected to a water flow pipe, said water flow pipe being structured and disposed to determine a rate of water flow through said internal coiled flow through path, said water flow pipe being further structured and disposed to cause said second switch to move from said normally closed position to an open position upon a drop in the rate of water flow through said internal coiled flow through path below a predetermined minimum water flow rate, a third of said switches being connected to an ambient temperature thermostat, said ambient temperature thermostat being structured and disposed to measure a temperature of said air drawn in through said ambient air intake, said ambient temperature thermostat being further structured and disposed to cause said third switch to move from said normally closed position to an open position upon a drop in the temperature of said air below a predetermined minimum ambient air temperature, a fourth of said switches being connected to a refrigerant pressure detection means, said refrigerant pressure detection means being structured and disposed to measure refrigerant pressure in said cooling means, said refrigerant pressure detection means being further structured and disposed to cause said fourth switch to move from said normally closed position to upon a drop in refrigerant pressure below a predetermined minimum refrigerant pressure amount, a fifth of said switches being connected to said refrigerant pressure detection means, said refrigerant pressure detection means being structured and disposed to measure refrigerant pressure build up within said compressor, said refrigerant pressure detection means being further structured and disposed to cause said fifth switch to move from said normally closed position to an open position upon an increase of the refrigerant pressure within said compressor above a predetermined maximum pressure capacity of said compressor, said first, second, third, fourth, and fifth switches being connected in series with one another such that only if all of said switches are in said normally closed position will said refrigeration unit be capable of running, timer means connected to a sixth switch, said timer means being structured and disposed to select predetermined times during which said sixth switch is in said normally closed position, said timer means including a clock, an adjustable on-time indicator and an adjustable off-time indicator, said sixth switch being structured and disposed such that if said sixth switch and said first, second, third, fourth, and fifth switches are in said normally closed positions, said refrigeration unit will be on, an automatic timer bypass, said automatic timer bypass including a seventh of said switches, said seventh switch being manually positionable between a closed position and an open position, said seventh switch being structured and disposed such that if said seventh switch is in said normally closed position, and said first, second, third, fourth, and fifth switches are in said normally closed positions, said refrigeration unit will be on regardless of a position of said sixth switch, and a main unit housing structured and disposed to contain therein said refrigeration unit, said plurality of switches, said water thermostat, said water flow pipe, said ambient temperature thermostat, said refrigerant pressure detection means, and said automatic timer bypass.

2. A heater unit as recited in claim 1 wherein said first switch, said second switch, said third switch, said fourth switch, and said fifth switch each include a corresponding indicator light structured and disposed to turn on when the corresponding one of said switches is in said open position.

3. A heater unit as recited in claim 2 wherein said first switch, said second switch, said third switch, said fourth switch, and said fifth switch each include a third wire connected to said corresponding indicator light, said third wire turning on said corresponding indicator light upon one of said switches moving to said open position.

4. A heater unit as recited in claim 3 further including a control plate mounted in said housing, said control plate including said indicator lights and, said automatic timer bypass, therein.

5. A self-regulating swimming pool heater unit comprising:

a refrigeration unit, said refrigeration unit including a compressor and an internal, coiled flow through path structured and disposed to enable the passage of filtered water therethrough, said refrigeration unit including an ambient air intake structured and disposed to draw heat from ambient air into said compressor, said refrigeration unit including cooling means structured and disposed to cool air drawn in through said ambient air intake, said cooling means including a refrigerant, said cooling means being structured and disposed to cause heat to be emitted by said refrigeration unit into said internal coiled flow through path thereby heating the water passing therethrough, a plurality of single pole, double throw switches, said switches being connected to said refrigeration unit and being disposed in a normally closed position, a first of said switches being connected to a water thermostat, said water thermostat being structured and disposed to periodically sample the water exiting said internal coiled flow through path so as to determine its temperature, said water thermostat being adjustably set to detect a desired water temperature, said water thermostat being further structured and disposed to cause said first switch to move from said normally closed position to an open position upon the water attaining said desired water temperature, a second of said switches being connected to a water flow pipe, said water flow pipe being structured and disposed to determine the rate of water flow through said internal coiled flow through path, said water flow pipe being further structured and disposed to cause said second switch to move from said normally closed position to an open position upon a drop in the rate of water flow through said internal coiled flow through path below a predetermined minimum water flow rate, a third of said switches being connected to an ambient temperature thermostat, said ambient temperature thermostat being structured and disposed to measure the temperature of said air drawn in through said ambient air intake, said ambient temperature thermostat being further structured and disposed to cause said third switch to move from said normally closed position to an open position upon a drop in the temperature of said air below a predetermined minimum ambient air temperature, a fourth of said switches being connected to a refrigerant pressure detection means, said refrigerant pressure detection means being structured and disposed to measure refrigerant pressure in said cooling means, said refrigerant pressure detection means being further structured and disposed to cause said fourth switch to move from said normally closed position upon a drop in refrigerant pressure below a predetermined minimum refrigerant pressure amount, a fifth of said switches being connected to said refrigerant pressure detection means, said refrigerant pressure detection means being structured and disposed to measure refrigerant pressure build up within said compressor, said refrigerant pressure detection means being further structured and disposed to cause said fifth switch to move from said normally closed position to an open position upon an increase of the refrigerant pressure within said compressor above a predetermined maximum pressure capacity of said compressor, said first, second, third, fourth, and fifth switches being connected in series with one another such that only if all of said switches are in said normally closed position will said refrigeration unit be capable of running, and a main unit housing structured and disposed to contain therein said refrigeration unit, said plurality of house of switches, said water thermostat, said water flow meter, said ambient temperature thermostat, and said refrigerant pressure detection means.

* * * * *